US006942578B2

(12) United States Patent
Adolf

(10) Patent No.: US 6,942,578 B2
(45) Date of Patent: Sep. 13, 2005

(54) GOLF BALL PLACEMENT DEVICE

(76) Inventor: Steven Adolf, 68 Stony Ridge Dr., Honeoye, NY (US) 14472

( * ) Notice: Subject to any disclaimer, the term of this patent is extended or adjusted under 35 U.S.C. 154(b) by 20 days.

(21) Appl. No.: 10/179,680

(22) Filed: Jun. 25, 2002

(65) Prior Publication Data

US 2003/0004004 A1 Jan. 2, 2003

Related U.S. Application Data

(60) Provisional application No. 60/302,349, filed on Jun. 29, 2001.

(51) Int. Cl.[7] ..... A63B 69/36
(52) U.S. Cl. ..... 473/137
(58) Field of Search ..... 473/132–137

(56) References Cited

U.S. PATENT DOCUMENTS

| | | | | | |
|---|---|---|---|---|---|
| 2,071,356 | A | * | 2/1937 | Pagett | 473/137 |
| 2,171,299 | A | * | 8/1939 | Beckett | 473/137 |
| 3,690,676 | A | | 9/1972 | Costa | |
| 4,146,232 | A | | 3/1979 | Stone | |
| 4,265,453 | A | | 5/1981 | Loof | |
| 4,360,204 | A | | 11/1982 | Karr | |
| 4,575,092 | A | | 3/1986 | Watson | |
| 4,796,893 | A | * | 1/1989 | Choi | 473/137 |
| 4,878,665 | A | | 11/1989 | Boudreau | |
| 4,892,318 | A | | 1/1990 | Jennings | |
| 4,928,417 | A | | 5/1990 | Boudreau | |
| 4,957,296 | A | | 9/1990 | Turnidge | |
| 4,995,614 | A | * | 2/1991 | Tange | 473/137 |
| 5,282,628 | A | | 2/1994 | Komori | |
| 5,326,107 | A | | 7/1994 | Park | |
| 5,346,222 | A | | 9/1994 | Luther | |
| 5,411,267 | A | | 5/1995 | Burks | |
| 5,458,339 | A | | 10/1995 | Wildes | |
| 5,464,223 | A | | 11/1995 | Dermott | |
| 5,580,318 | A | | 12/1996 | Weber | |
| 5,624,325 | A | | 4/1997 | Smith | |
| 5,632,687 | A | | 5/1997 | Bunyi | |
| 5,665,004 | A | | 9/1997 | Vlahovic | |
| 5,697,176 | A | | 12/1997 | Kuni | |
| 5,704,844 | A | | 1/1998 | Luther | |
| 5,895,325 | A | | 4/1999 | Tomey | |
| 5,971,862 | A | * | 10/1999 | Yates | 473/137 |
| D428,088 | S | | 7/2000 | Cameron et al. | |
| 6,106,405 | A | * | 8/2000 | Fox | 473/137 |
| 6,110,059 | A | | 8/2000 | Haggerty | |
| 6,139,441 | A | | 10/2000 | Fairchild | |
| 6,159,105 | A | | 12/2000 | Henry | |
| 6,315,676 | B1 | * | 11/2001 | Sandlin | 473/137 |

* cited by examiner

*Primary Examiner*—Steven Wong
(74) *Attorney, Agent, or Firm*—Knoble Yoshida & Dunleavy, LLC

(57) ABSTRACT

A golf ball placement device including a housing, a golf ball container, a actuator which can be actuated to place a golf ball, a tube which can hold a golf ball at its vertical position and place the golf ball at a particular position after being rotated to a horizontal position, and a transmission linkage that links the motion of the actuator to the pivotal motion of the tube is disclosed. The transmission linkage is properly balanced using springs and/or weights so that only a minimum force is needed to actuate the actuator in order to place a golf ball. The device may further include a tee height adjuster to adjust the extent of the rotation of tube to enable the device to dispense a golf ball at a proper height. The device may further optionally include a cover and a place to hold an advertisement. The device may be further made into an ultra portable model by adding a side cover which can be partially flipped open to serve as a golf practice tee.

20 Claims, 16 Drawing Sheets

GOLF BALL PLACEMENT DEVICE

This application claims benefit of 60/302,349 filed on Jun. 29, 2001.

BACKGROUND OF THE INVENTION

1. Field of the Invention

The present invention relates to a golf ball placement device for placing golf balls.

2. Description of the Prior Art

Golf is a popular sport throughout the world and continues to grow in popularity. Golf is also a demanding sport which requires regular practice in order to maintain and improve the skills of a golfer. In addition to playing rounds of golf on a golf course, golfers often practice regularly by hitting balls at a practicing facility.

When practicing their driving at a driving range, the golfers must place a golf ball for a shot. Manually placing a golf ball on a tee requires bending of a golfer's back. This repeated bending to place the ball is tiresome and even potentially hazardous, especially for elderly golfers or golfers with back or weight problems.

A golf ball placement device provides an efficient and less tiresome method for placing golf balls. Another benefit of the golf ball placement device is that the golfer can maintain his stance and grip in the same position when hitting successive balls. The ability to maintain stance and grip improves concentration and provides a repetitive stroke capability which is often beneficial in a practice session.

A number of golf ball placement devices have been developed to assist the golfer in placement up the golf ball during a practice session.

U.S. Pat. No. 4,391,446 to Eberle discloses a dispenser with a movable arm maintained in spring tension. The arm pivots in a horizontal plane and includes a dispensing head at the fixed end of the dispenser tube to limit the flow of golf balls into the tube. A golfer must rotate the arm with a club and then tilt or rock the dispensing head forward to release the first ball and then rearward to position the ball on the tee and block the other balls. The golf balls have a tendency to jam up in the hopper and the dispensing head is difficult to coordinate.

U.S. Pat. No. 4,892,318 to Jennings discloses a golf ball storage, dispensing and placement device containing a swing tube which can be pulled down by the golfer through a hook on the swing tube using his golf club head. The golf ball is released because of gravity.

A motor driven placement device is disclosed in U.S. Pat. No. 4,732,391 to Karr.

This placement device requires a motor and complex gear assembly to position the arm mechanism.

U.S. Pat. Nos. 4,957,296 and 5,071,131 to Turnidge et al. also disclose a vertical arm for dispensing golf balls. The device includes an operating pedestal and pulley system which moves the arm from an upright position to dispense a golf ball. The device includes an upper and lower golf ball stop to prevent more than one ball at a time from entering the guide track.

U.S. Pat. No. 4,995,614 to Tange discloses a vertical arm with a return spring. Tange describes the frequent problem of golf ball jams in the storage hopper of a golf ball placement device. The golf ball dispenser shown in Tange includes internal baffles with a zigzag vertically rising single column to eliminate the possibility of balls jamming in the storage hopper.

Another golf ball placement device is disclosed in U.S. Pat. No. 5,326,107 to Park. The arm is motorized and moves only in a horizontal direction. A guide wire is used to maintain the ball on the arm until the ball is positioned above the tee.

U.S. Pat. No. 5,624,325 to Smith discloses a movable channel arm which the golfer must push down to dispense a golf ball. Smith also discloses an agitator, which moves every time a golf ball is dispensed, to prevent golf balls from jamming.

Although a number of golf ball placement devices are known, a multitude of mechanisms and installation requirements result in complex operations. The devices are expensive and difficult to maintain such that few golf ball placement device have achieved success in the market place. Many of them are also too heavy and bulky to be portable.

It is therefore an objective of certain embodiments of the present invention to provide a golf ball placement device that is lightweight and portable.

It is another object of certain embodiments of the invention to provide a golf ball placement device which can position one golf ball at a time.

Another object of certain embodiments of the present invention is to provide a golf ball placement device which can dispense a number of balls from a golf ball container without jamming the balls.

A further object of certain embodiments of the present invention is to provide a golf ball placement device which requires a minimum amount of force to be actuated to dispense a golf ball.

These and other objects of the present invention will be apparent from the summary and detailed description of the invention which follow.

SUMMARY OF THE INVENTION

In a first aspect, the present invention relates to a golf ball placement device which contains a housing; a golf ball container located in the housing; a tube for dispensing (placing) golf balls pivotally attached to the housing, an actuator, and a transmission linkage that links the actuator and the tube. In the device, when the actuator is actuated by a minimum force, the transmission linkage causes the tube to place a ball at a particular location.

In a second aspect, the present invention relates to a golf ball agitator which is pivotally connected to the housing of a golf ball placement device for placing one golf ball at a time, wherein the agitator is pushed upward each time a golf ball is placed to agitate the golf balls in order to substantially prevent jamming of golf balls in the device.

In a third aspect, the present invention relates to a transmission linkage, which can be used in a golf ball placement device of the present invention to convert a downward movement of the actuator of the golf ball placement device into a rotating movement of the ball placement tube of the golf ball placement device.

In a fourth aspect, the present invention relates to a portable golf ball placement device.

DETAILED DESCRIPTION OF THE PREFERRED EMBODIMENTS

In a first aspect, the present invention relates to a golf ball placement device which contains a housing; a golf ball container located in the housing; a tube for dispensing golf balls attached to the housing, an actuator, and a transmission linkage that links the actuator and the tube. In the device, the actuator is actuated by a golfer using its club head. Due to the transmission linkage, the tube is rotated to place a golf ball. When the actuator is released, the actuator returns to its rest position and consequently the tube also returns to its rest position. The tube then recharges itself with another golf ball from the golf ball container. The transmission linkage that links the tube and the actuator is properly balanced so that it takes a minimum force to actuate the actuator in order to rotate the tube and place a golf ball.

Figure 1:
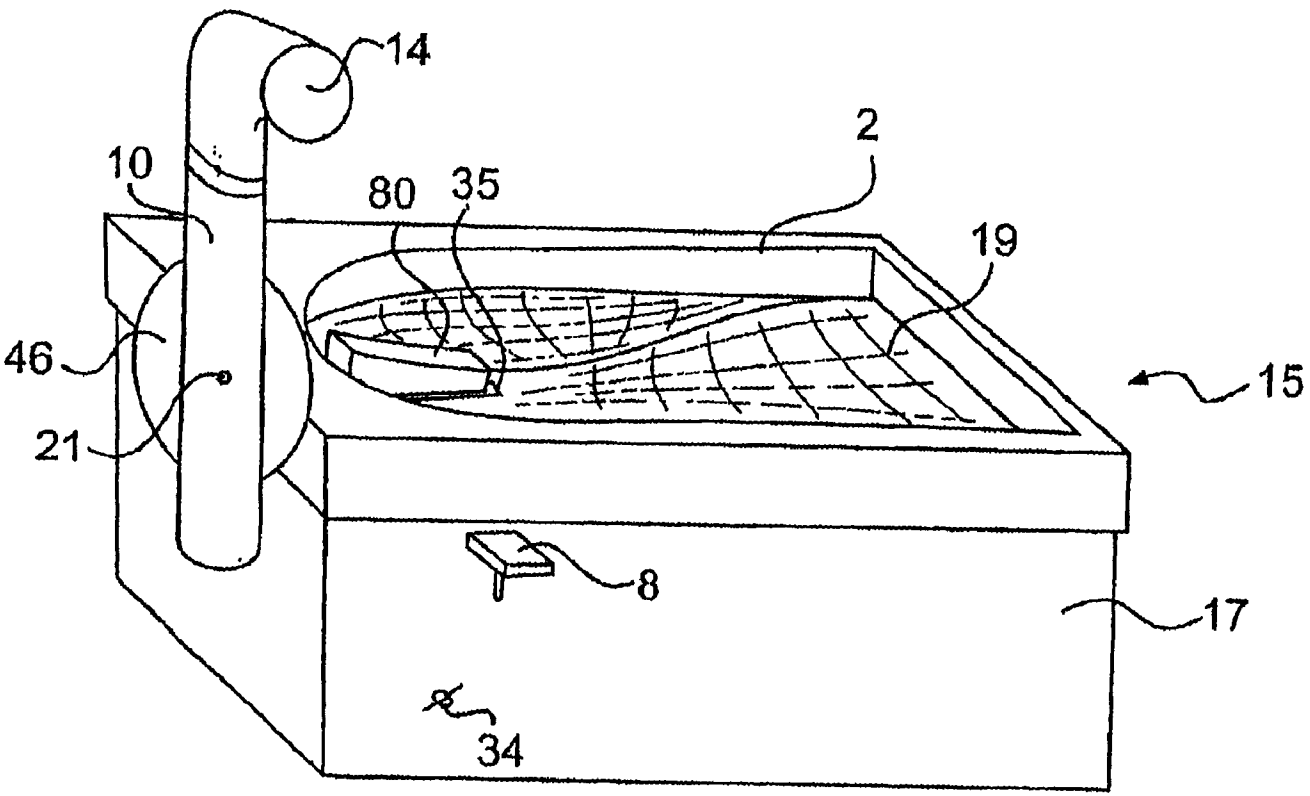
FIG. 1 is an elevated side view of a first embodiment of a fully assembled golf ball placement device of the present invention.
Figure 2:
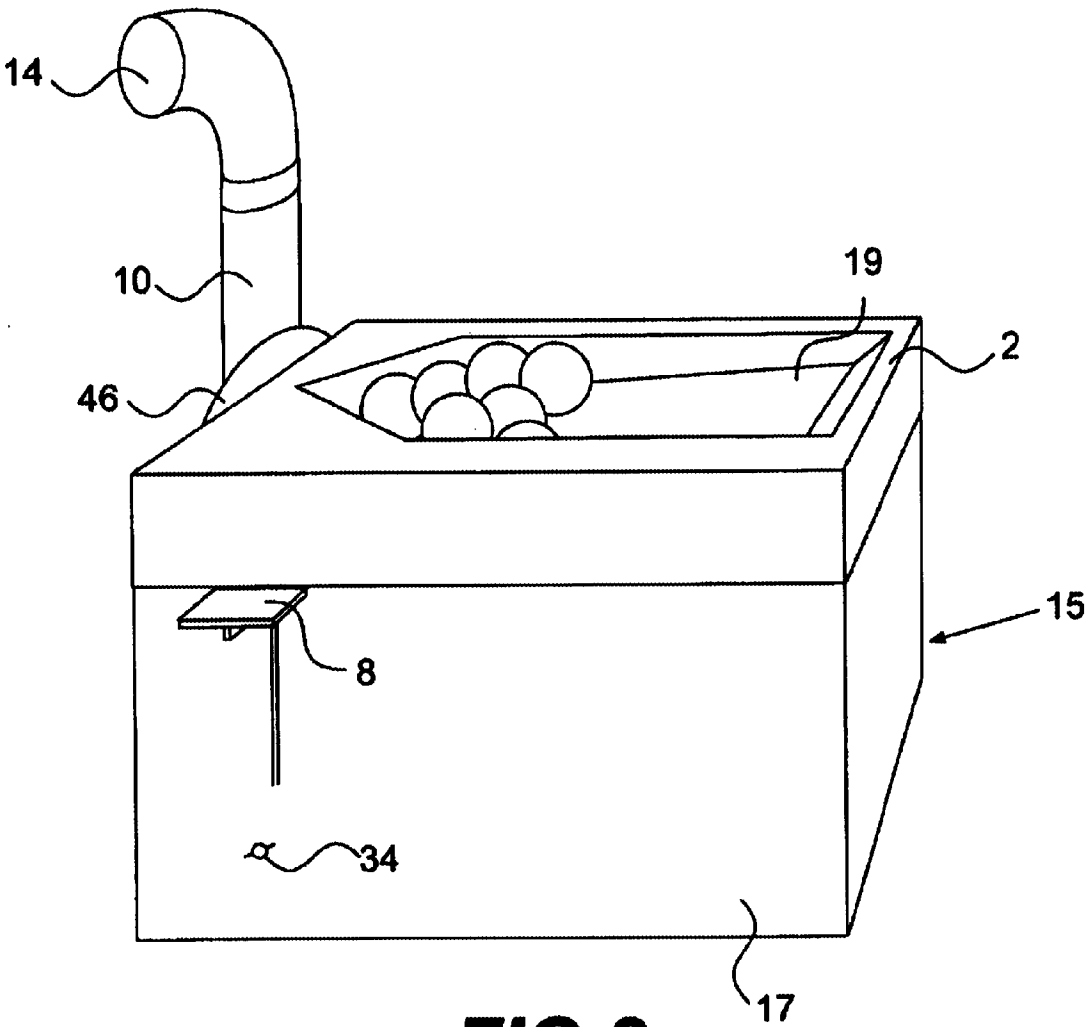
FIG. 2 is a perspective view of the first embodiment of the fully assembled golf ball placement device with a plurality of golf balls in its container.
Figure 3:
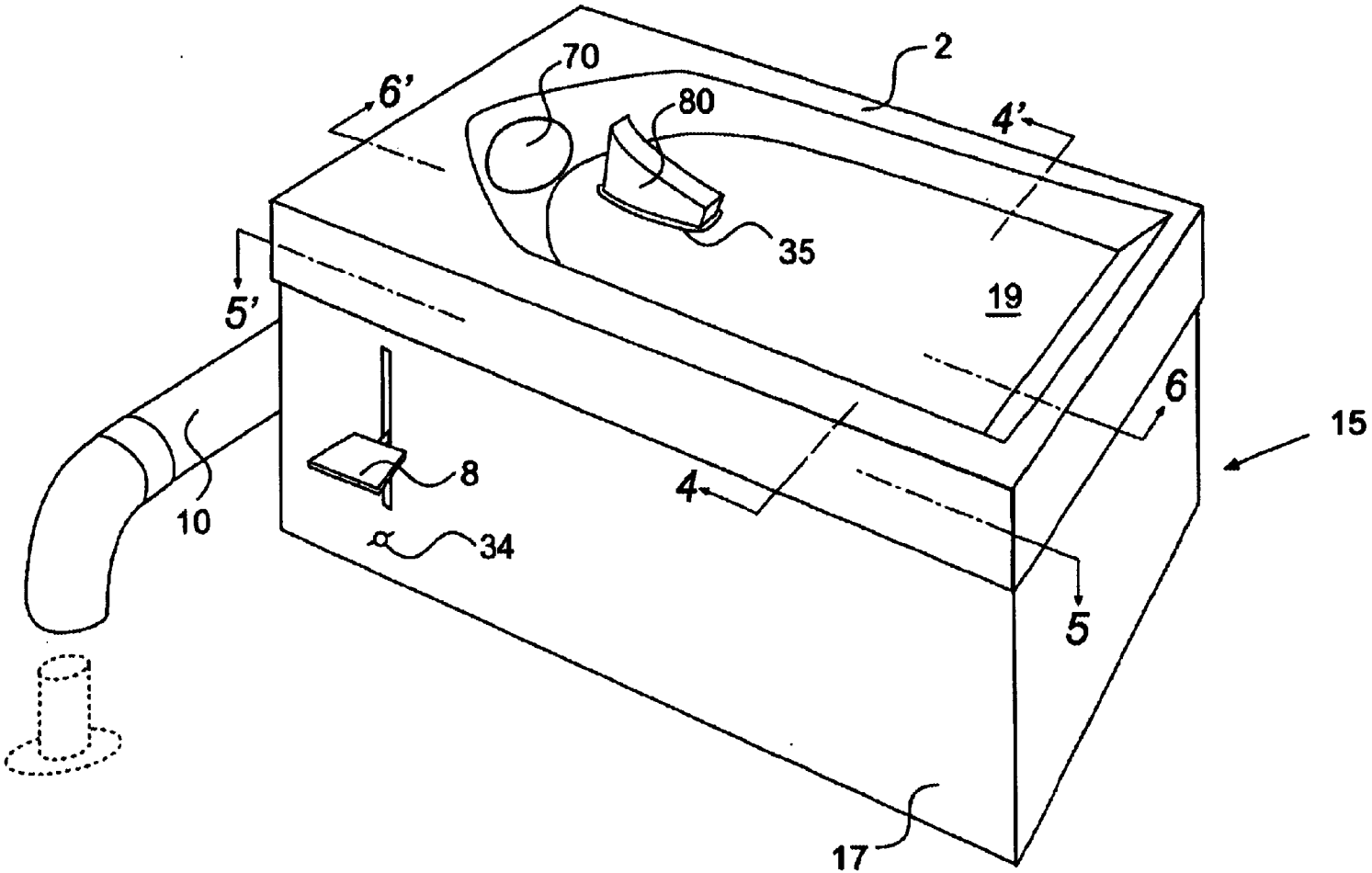
FIG. 3 is another perspective view of the first embodiment of the fully assembled golf ball placement device of the present invention when it is dispensing a golf ball.

Referring now to the drawings, a golf ball placement device 15 is shown in FIGS. 1–3. FIG. 1 of the drawings illustrates a fully assembled golf ball placement device 15 of the present invention in the rest position. As shown in FIG. 1, placement device 15 includes a housing 17, a tube 10 attached to the housing, a golf ball container 2 located in housing 17, an actuator 8 and other components that are not visible in FIG. 1. Also shown in FIG. 1 is a head 80 of an agitator 48 (not shown) located in slot 35 of container 2 with a bottom as well as a tee height adjuster 34.

FIG. 2 shows golf ball placement device 15 with multiple golf balls in its golf ball container 2.

FIG. 3 shows the golf ball placement device during placement of a golf ball when actuator 8 is actuated. An important feature of this embodiment of the device of the present invention is that it requires a minimum force, such as the weight of a golf club, to actuate actuator 8. Also shown in FIG. 3 is a golf ball outlet 70 used for passage of golf balls from container 2 to tube 10.

Figure 4:
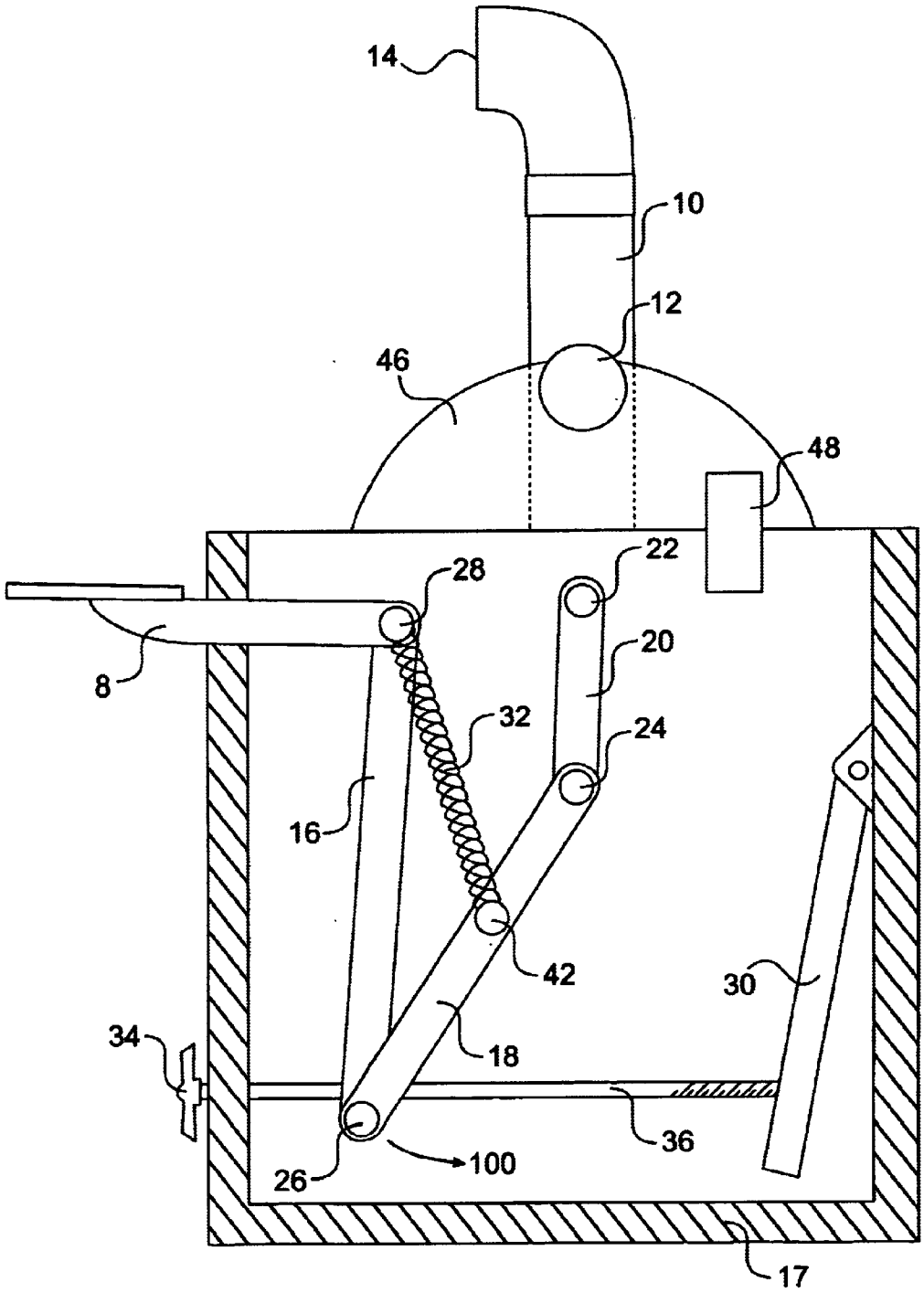
FIG. 4 is a cross-sectional view of the golf ball placement device of the present invention along lines 4–4' in FIG. 3.
Figure 5:
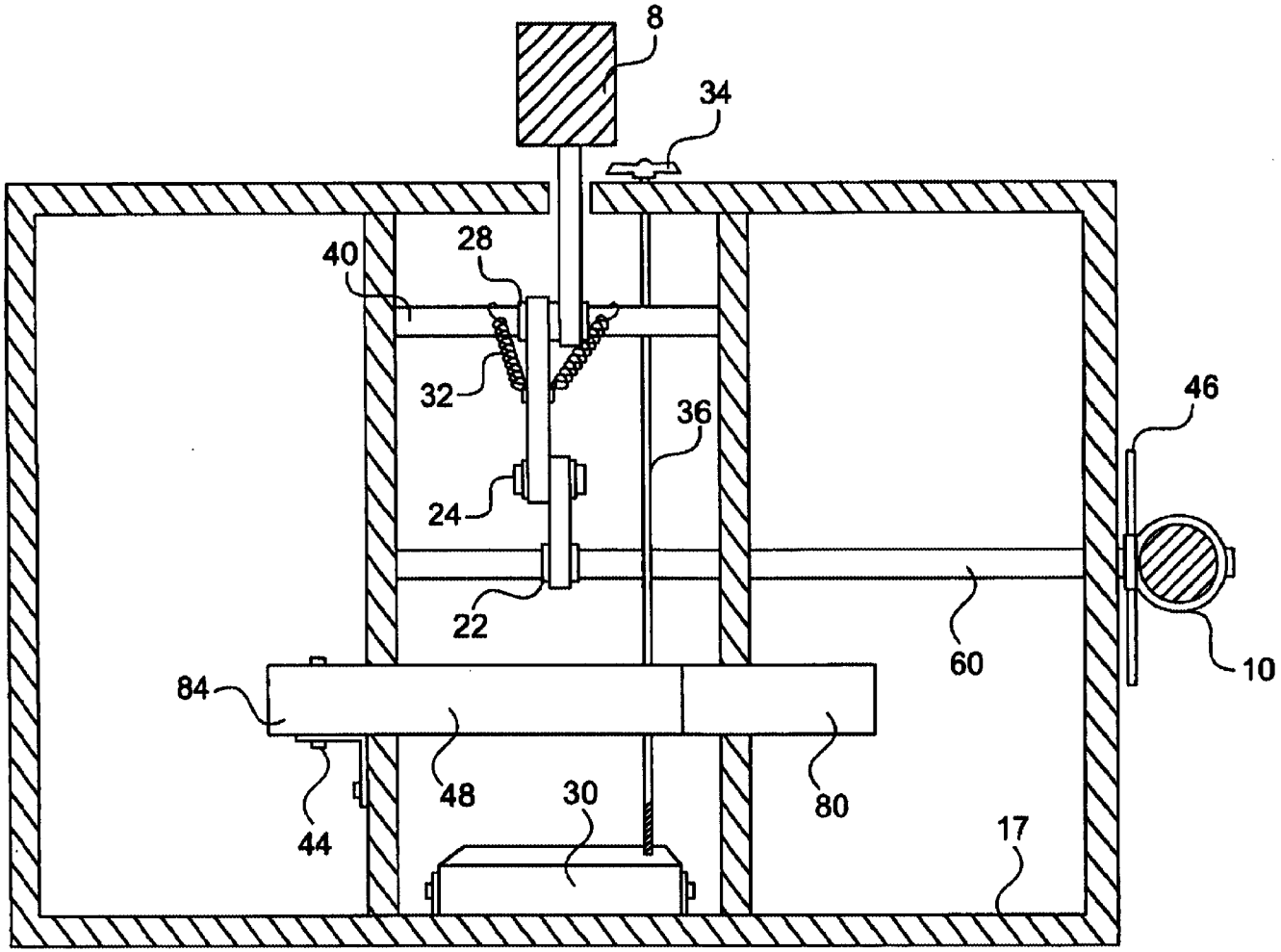
FIG. 5 is a cross-sectional view of the golf ball placement device of the present invention along line 5–5' in FIG. 3.

FIGS. 4 and 5 show two cross-sectional views of this device. Actuator 8 is rigidly linked to one end of lever 16 and shaft 40 (shown in FIG. 5) via nuts assembly 28. Optionally, actuator 8 can also be welded to one end of lever 16 without using nuts assembly 28. When the welding linkage is used to link actuator 8 and lever 16, actuator 8 and lever 16 can optionally rotate around shaft 40 without being rigidly linked to shaft 40 (shown in FIG. 8). Shaft 40 inserts its two ends into housing 17 and may or may not be able to rotate freely against housing 17. Therefore, when actuator 8 is pressed down, lever 16 move around shaft 40 in the direction shown by arrow 100. Another end of lever 16 is pivotally linked to one end of an extension arm 18. The other end of extension arm 18 is pivotally linked with one end of lever 20. The other end of lever 20 is rigidly link to shaft 60. Both ends of shaft 60 are inserted into housing 17. Shaft 60 is substantially parallel to shaft 40. Shaft 60 can rotate against housing 17. When actuator 8 is pressed down by a minimum force, lever 16 moves in the direction shown by arrow 100. Lever 16 in turn push lever 20 in the same direction to rotate shaft 60. Tube 10 is rigidly attached to shaft 60. When shaft 60 rotates counter clockwise, tube 10 rotates with shaft 60 to a substantially horizontal position so that a golf ball being hold inside tube 10 will roll out of open end 14 onto a golf tee (shown in the dotted line in FIG. 3) due to gravity of the golf ball to complete the placement process.

When the force on actuator 8 is removed, due to proper weight balancing of tube 10, actuator 8, lever 16, lever 20 and extension arm 18, shaft 40 and shaft 60 all rotate back to their rest positions before actuator 8 is pressed down by the minimum force. In the mean time, actuator 8 returns to its rest position before its being pressed down and tube 10 rotates back to its substantially vertical position as shown in FIGS. 1 and 2. After rotating to its substantially vertical position, tube 10, which now does not contain a golf ball inside, can accept another golf ball from golf ball container 2. Due to gravity, another golf ball will roll into the now empty tube 10 through a golf ball outlet 70 in golf ball container 2 and through a ball blocker 46 having an aperture 12 (shown in FIGS. 4 and 16) attached on arm 10. Aperture 12 matches outlet 70 when tube is in its substantially vertical position. Only one golf ball will roll into tube 10 due to the size of tube 8 and the size of aperture 12. Ball blocker 46 is closed to additional golf balls from golf ball container 2 when tube 10 is in its substantially horizontal position. Once the golf ball rolls into tube 10, tube is ready to place the golf ball onto a tee by repeating the above process. During this process of placing a golf ball, only a minimum force is required to press down actuator 8 to place a golf ball due to the proper weight balancing of tube 10, actuator 8, lever 16, lever 20 and extension arm 18. Lever 16, lever 20, shaft 40, shaft 60 and extension arm 18 are elements of an embodiment of a transmission linkage of the present invention, which is, therefore, properly balanced as well.

Preferably, extension arm 18 has a proper weight. Extension arm 18 is further linked to shaft 40 through at least one spring 32 at point 42. When actuator 8 is pressed down, shaft 40 rotates and lever 16 moves in the direction shown by arrow 100. Lever 16 in turn push lever 20 in the same direction to rotate shaft 60. At same time spring 32 relaxes to counter the weight of extension arm 18 because the elongation of spring 32 decreases during this movement. The retraction force during relaxation of spring 32 is properly adjusted to balance the weight of extension arm 18 in such a way that a minimum force is required to press down actuator 8 in order to rotate shaft 60.

Preferably, tube 10 may include a weight component 560 (shown in FIG. 9), which can optionally be an element of an embodiment of a transmission linkage of the present invention. The weight of the weight component 560 can be adjusted so that a minimum force is required to press down actuator 8. The method to adjust the weight of weight component 560 so that a minimum force is required to press down the actuator to dispense a golf ball is well known to a person skilled in the art.

Figure 15:
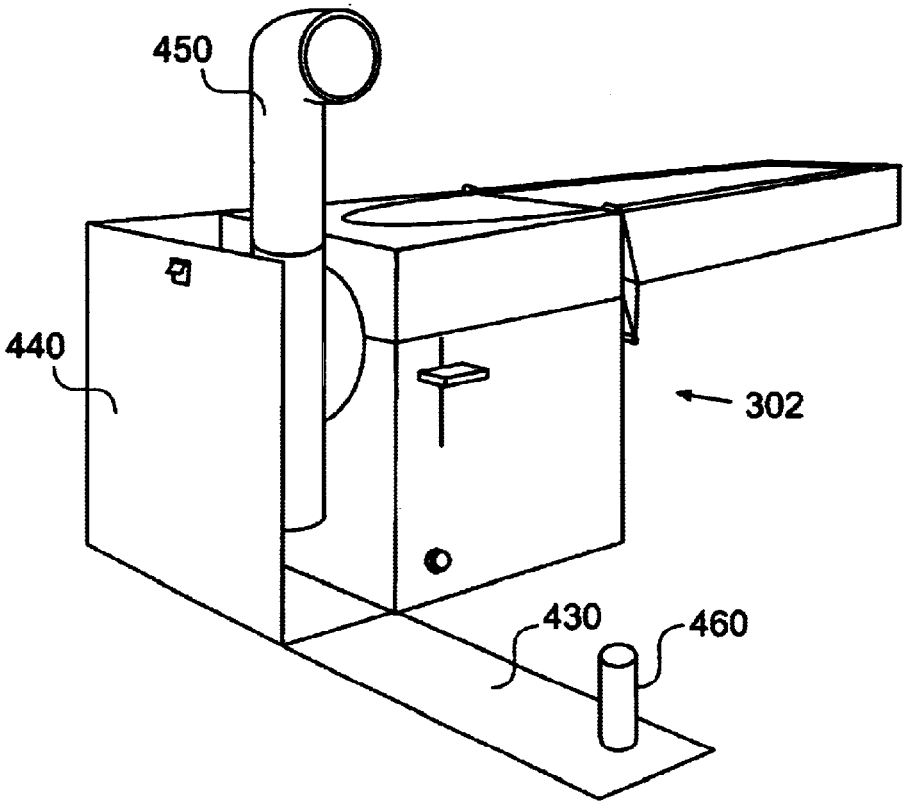
FIG. 15 is an elevated side view of a portable golf ball placement device of the present invention with both the top cover and the side cover when both covers are open.
Figure 16:
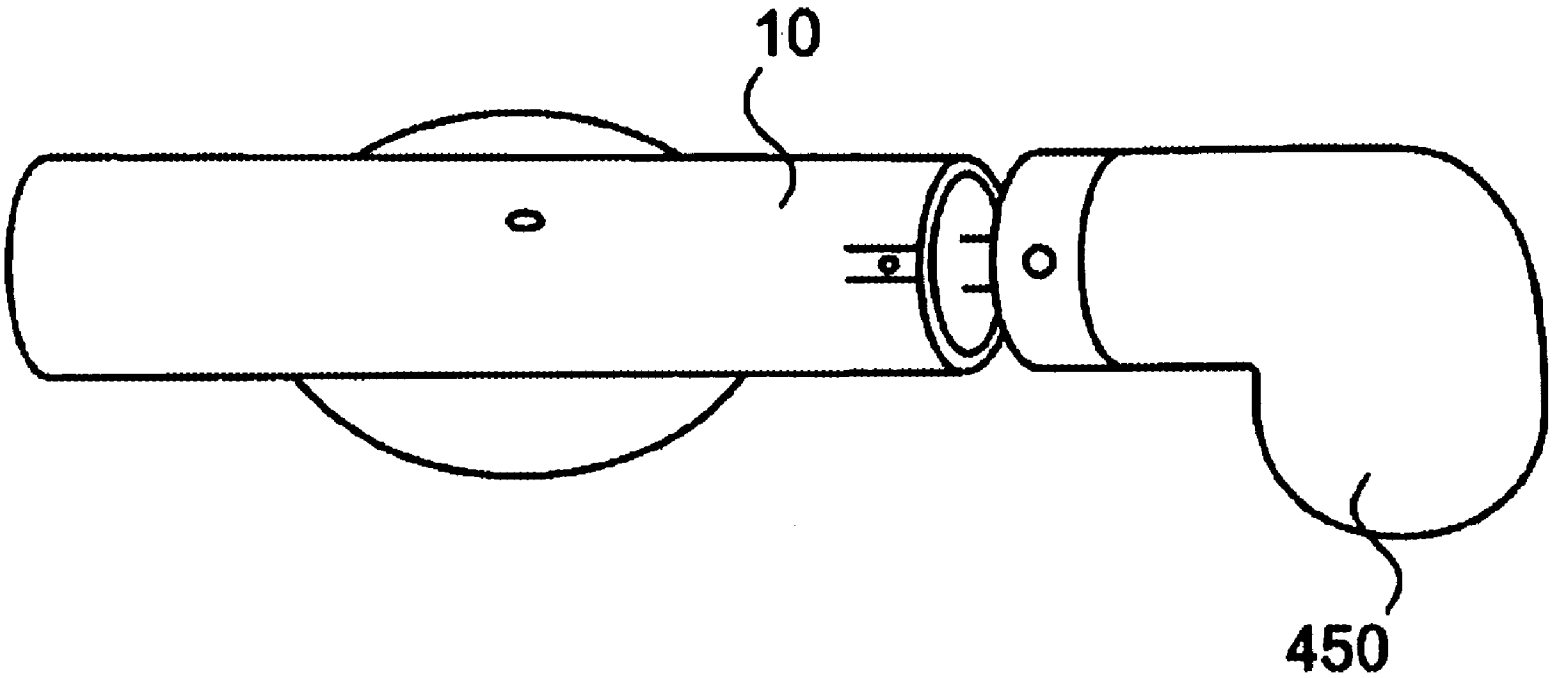
FIG. 16 is an elevated side view of another embodiment of a tube of a golf ball placement device of the present invention with a detachable head.

Preferably, tube 10 may have a detachable head 450 as shown in FIGS. 15–16. The dimension of head 450 can be adjusted to suit different driving range dimension, tee height, personal preference or to give a tube 10 with a different length.

Preferably, the device of the present invention further includes a tee height adjuster 34 (shown in FIGS. 1–5), which can adjust the degree of the rotation of tube 10 based on the height of the tee being used by a golfer. Adjuster 34 can be a hand adjustable screw with a long shaft 36. Adjuster 34 has external screw thread on its shaft 36. The head of screw 34 is screwed into a rotation stopper 30, which is pivotally linked to housing 17 at one end of rotation stopper 30. Rotation stopper 30 has an internal screw thread, which fits the external screw thread on shaft 36. Adjuster 34 also passes through housing 17 and can rotate freely against housing 17. When adjuster 34 is turned by hand against housing 17, due to the screw threads on shaft 36 and in rotation stopper 30, shaft 36 can pull or push rotation stopper 30 to a certain position. The position of rotation stopper 30 can limit the movement of extension arm 18 by block the movement pathway of extension arm 18 at a proper position, therefore, to control the degree of rotation of both shafts 40 and 60. The controlled degree of rotation of shaft 60 in turn controls the degree of rotation of tube 10. The height of open end 14 at the end of the rotation of tube 10 is thus controlled. Therefore, a golf ball can be properly placed at a controlled height to a golf tee.

Figure 14:
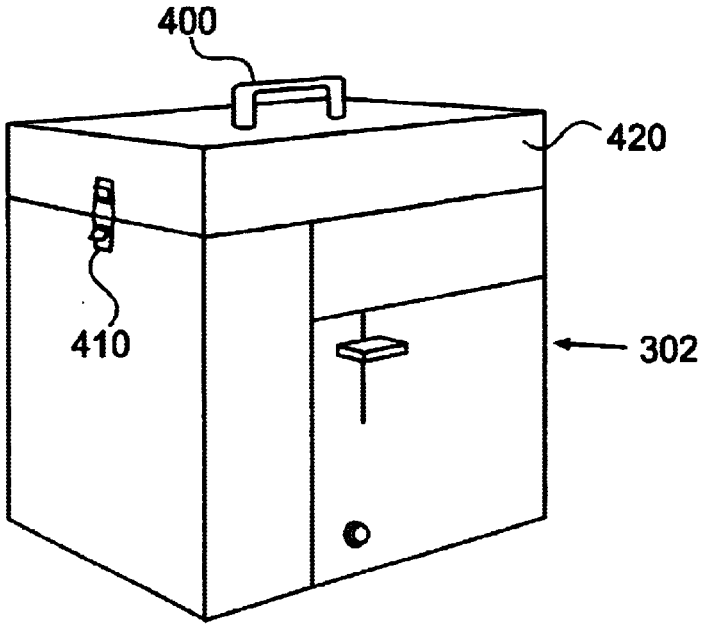
FIG. 14 is an elevated side view of a portable golf ball placement device of the present invention with both a top cover and a side cover when both covers are closed.

It is a further embodiment of the present invention that external surface of housing 17 is flat. Therefore, an advertisement can be easily attached to the housing of the device of the present invention. FIG. 14 shows a device of the present invention with a place 390 for an advertisement.

Figure 6:
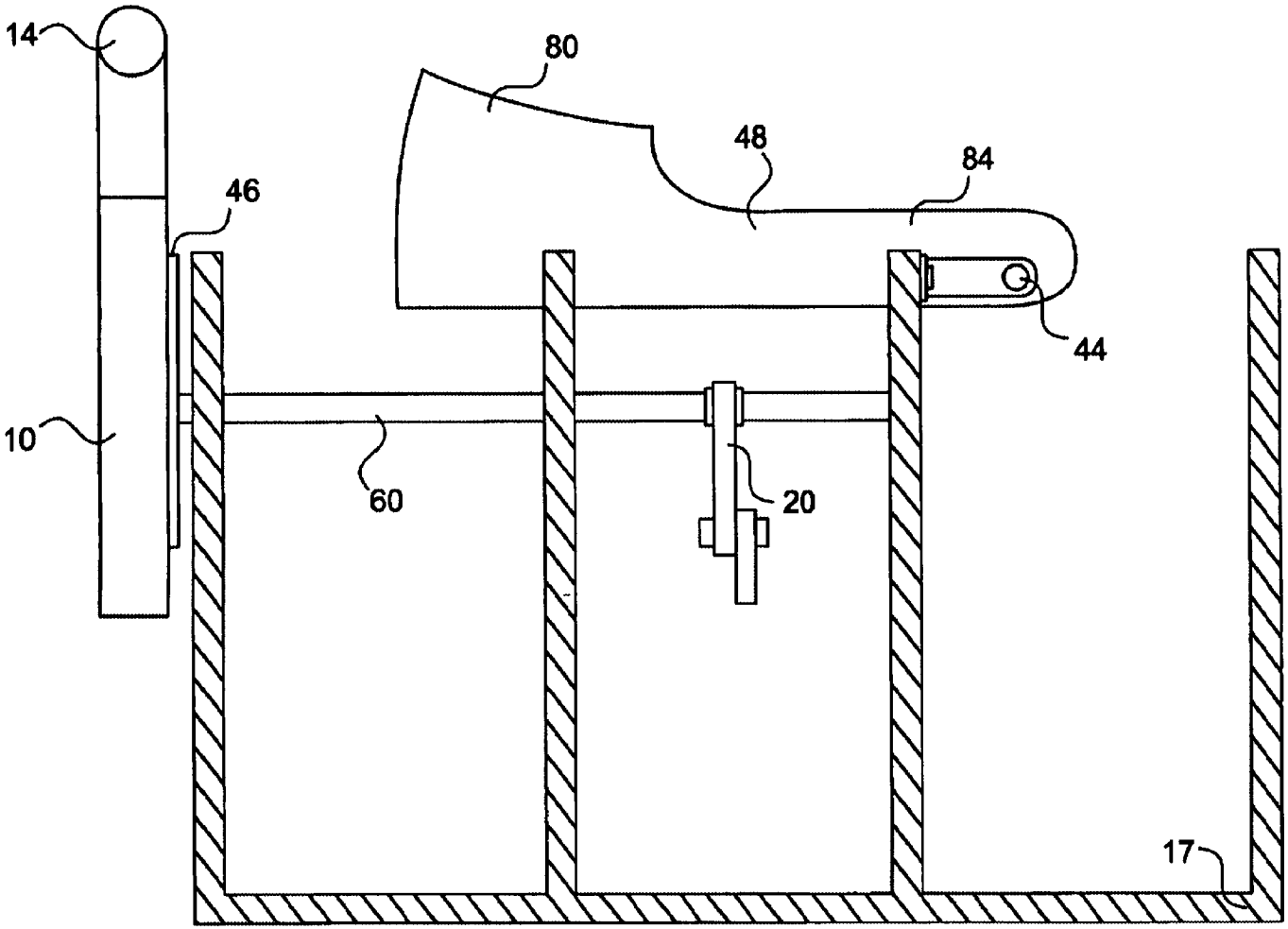
FIG. 6 is another cross-sectional view of the golf ball placement device of the present invention along line 6–6' in FIG. 3.

Preferably the golf ball placement device of the present invention further includes a golf ball agitator 48 (shown in FIGS. 5–6) having a head 80 and a narrow end 84, which is described in detail below, pivotally attached to the housing to reduce or prevent golf balls from jamming. During the actuator's being pressed down process, the actuator also actuates the golf ball agitator to agitate the golf balls in the golf ball container so that the movement of the agitator can reduce or eliminate the chance of ball jamming in this device.

Preferably, ball container of the golf ball placement device of the present invention has a slot 35 at its bottom so that head 80 of agitator 48 can penetrate through slot 35.

In a second aspect, the present invention relates to a golf ball agitation system which can be used in a golf ball placement device to prevent golf balls from jamming. The agitation system is shown in FIGS. 3–6 as a part of the golf ball placement device. The agitation system includes agitator 48, a transmission linkage of the present invention, golf ball container 2 having slot 35 on its bottom. Agitator 48 has a narrow end 84 and a head 80. Head 80 of golf ball agitator 48 is partially inserted through slot 35 at the bottom of golf ball container 2 and can move partially against the container when agitator 48 is actuated indirectly by actuator 8 through the transmission linkage of the present invention. Narrow end 84 of ball agitator 48 is pivotally linked to housing 17 using a nut-bolt assembly 44 or other equivalent devices. Head 80 of ball agitator 48 can be pushed upward by lever 20 when lever 20 rotates to a certain degree because of the downward movement of actuator 8. When actuator 8 returns to its rest position, lever 20 will rotate back to its rest position and head 80 of ball agitator 48 will drop back to its rest position. During its being pushed upward and dropping back to its rest position, head 80 of ball agitator 48 moves against ball container 2 through slot 35 to agitate the golf balls in golf ball container 2 to loose the golf balls and prevent the balls from jamming.

It is a feature of the present invention that the slot 35 is at the bottom of ball container 2, which makes the agitation more efficient. Therefore, when agitator 48 moves up and down through slot 35 at the bottom of ball container 2, a majority of the golf balls in container 2 are agitated efficiently. Preferably, head 80 of agitator 48 has such a substantial length that it extends through a substantial portion of the bottom of ball container 2. More preferably, head 80 of the agitator 48 has a length of at least 2 inches in the horizontal direction of FIG. 1. Most preferably, head 80 of the agitator 48 has a length of at least 3 inches.

Preferably, head 80 of agitator 48 of the present invention extends close to outlet 70, through which a golf ball rolls into tube 10. Therefore, the golf balls close to outlet 70 are agitated more efficiently. More preferably, the distance between the agitator and the outlet for golf ball delivery is less than 3 inches. Most preferably, the distance between the agitator and the outlet for golf ball delivery is less than the diameter of a standard golf ball so that no golf ball can be jammed between agitator 48 and outlet 70.

Figure 7:
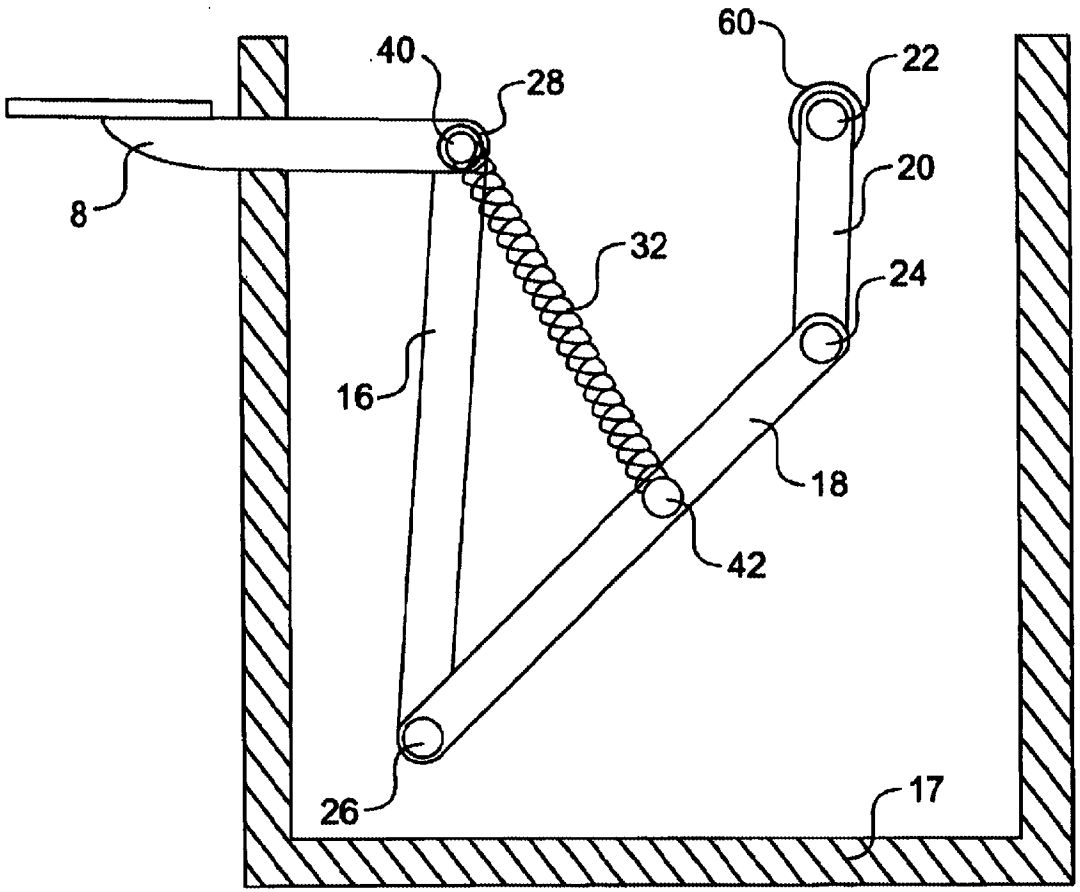
FIG. 7 is an illustrative view of a first embodiment of a transmission linkage of the present invention.

In a third aspect the present invention relates a transmission linkage that can be used in a golf ball placement device to enable the golf ball placement device to deliver a golf ball onto a tee when a minimum force being applied to the actuator of the golf ball placement device. A first embodiment of the transmission linkage, which can be used in the golf ball placement device of the present invention, comprises rigid connection 28, lever 16, pivotal connection 26, shaft 40, shaft 60, extension arm 18, pivotal connection 24, lever 20, spring 32 and rigid connection 22 are shown FIGS. 4–7. FIG. 7 shows the elements of the first embodiment of the transmission linkage having been described in FIGS. 4–6 without showing the entire golf ball placement device. Other embodiments of the transmission linkage of the present invention serving the similar function, which is to convert the downward motion of actuator 8 into a rotating motion of shaft 60 while a minimum force is required to press down actuator 8, are illustrated in FIGS. 8, 10–12.

Figure 8:
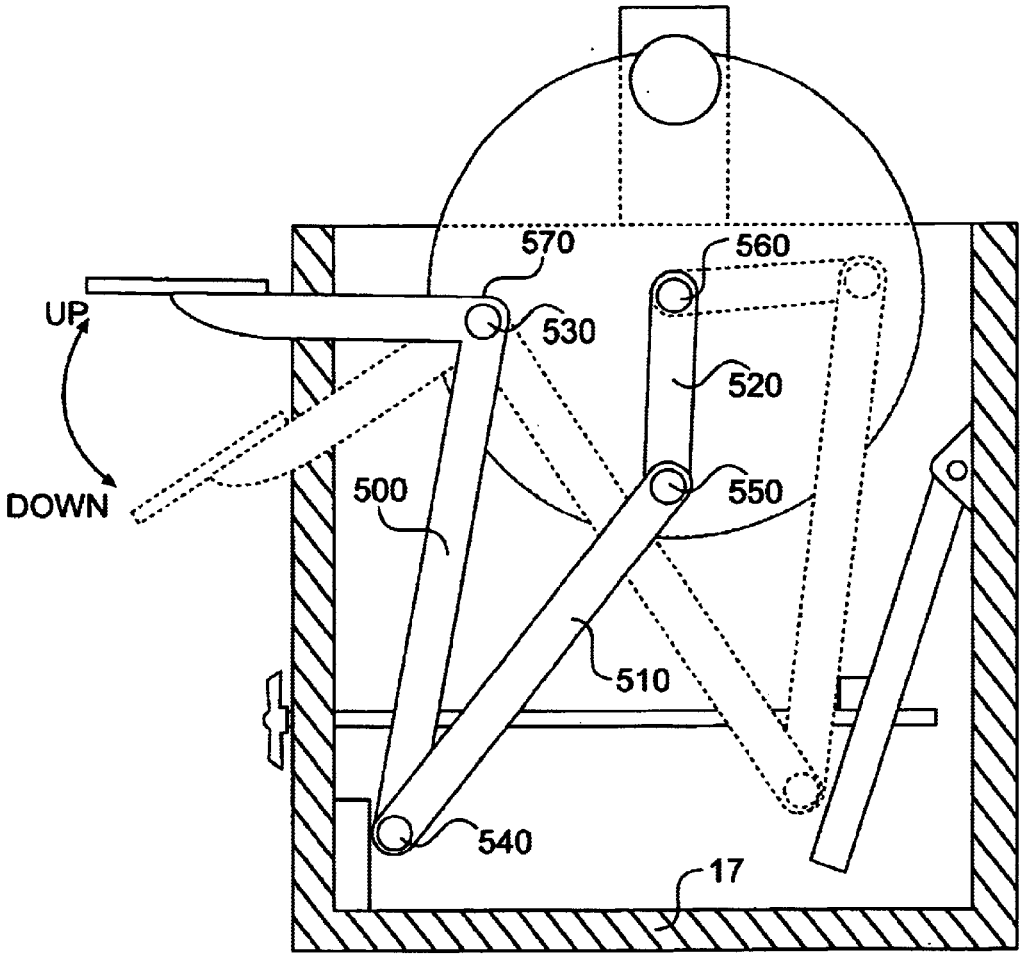
FIG. 8 is a cross sectional view of a golf ball placement device of the present invention showing a second embodiment of a transmission linkage of the present invention.
Figure 9:
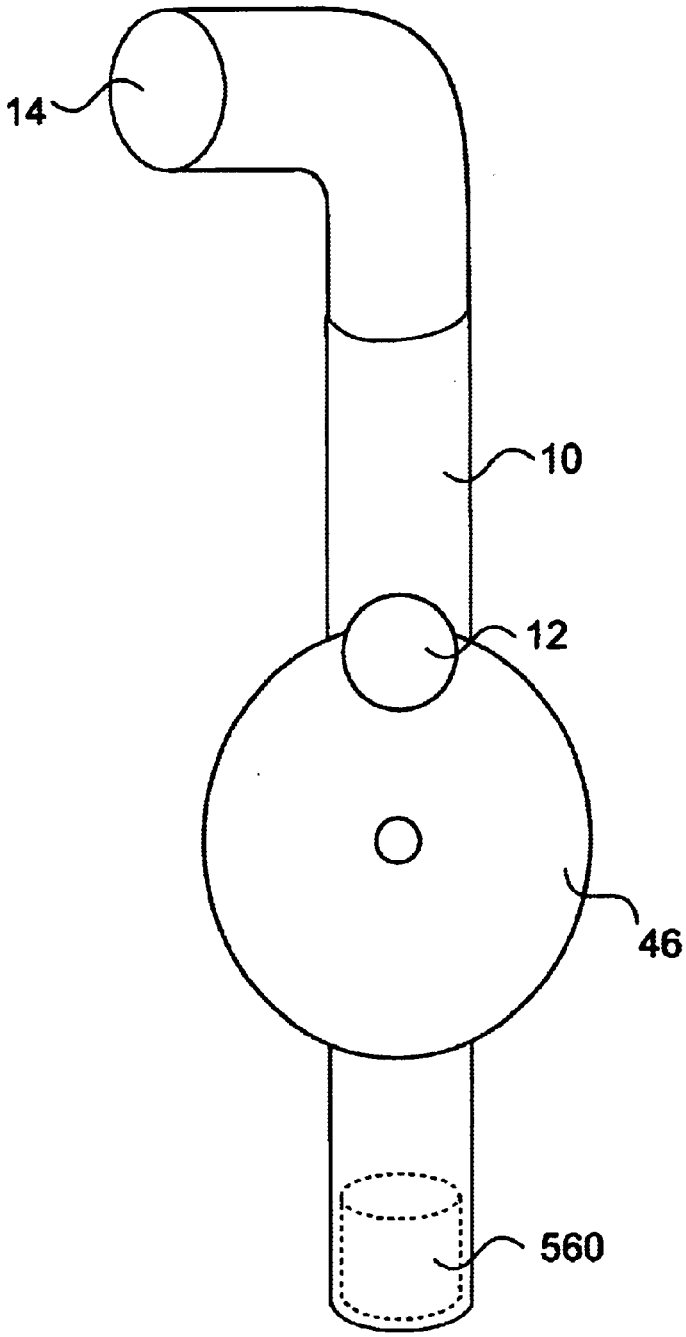
FIG. 9 is shows a tube of a golf ball placement device of the present invention for dispensing golf balls.

FIG. 8 shows a second embodiment of the transmission linkage of the present invention. Actuator 8 (not a part of the transmission linkage) is rigidly linked to a lever 500 at one end of lever 500 through a shaft 40, which can be inserted into housing 17. Lever 500 is pivotally linked to one end of an extension arm 510. The other end of extension arm 510 is pivotally linked to one end of a lever 520. The other end of lever 520 is rigidly linked to tube 10 through a shaft 560, which can be inserted into housing 17. In addition to these components, the transmission linkage further includes a balance component 560 located at bottom of tube 10 as shown in FIG. 9. The weight of balance component 560 is properly selected to enable a golfer to press down actuator 8 with a minimum force.

Figure 10:
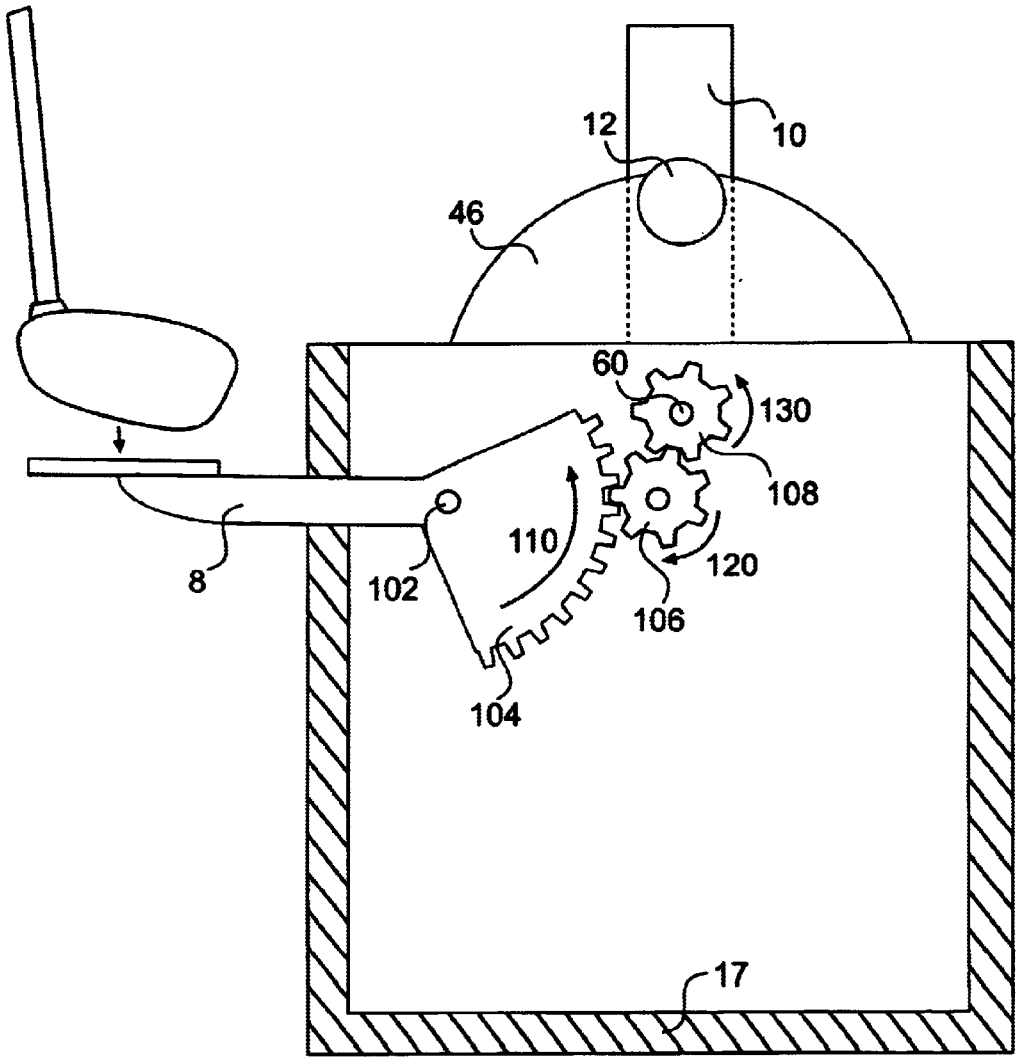
FIG. 10 is an illustrative view of a third embodiment of a transmission linkage of the present invention.

FIG. 10 shows a third embodiment of the transmission linkage of the present invention. Actuator 8 (not a part of the transmission linkage) is rigidly linked to a gear 120, which is rigidly linked to a lever 150. Gear 120 is attached housing 17 (not a part of the transmission linkage) in such a way that gear 120 can rotate against housing 17. Lever 150 is connected to housing 17 (not a part of the transmission linkage) via a spring 160. Gear 120 transfers its rotation through gear 130 to gear 140 which is rigidly linked to shaft 60. When actuator 8 is pressed down with a minimum force, gear 120 rotates and lever 150 moves in the direction of arrow 200. Gear 140 also rotates in the same direction to rotate shaft 60, which in turn drives tube 10 to dispense a golf ball. The tension in spring 160 is properly adjusted in such a way that a minimum force is required to press down actuator 8 to accomplish all those rotations.

Figure 11:
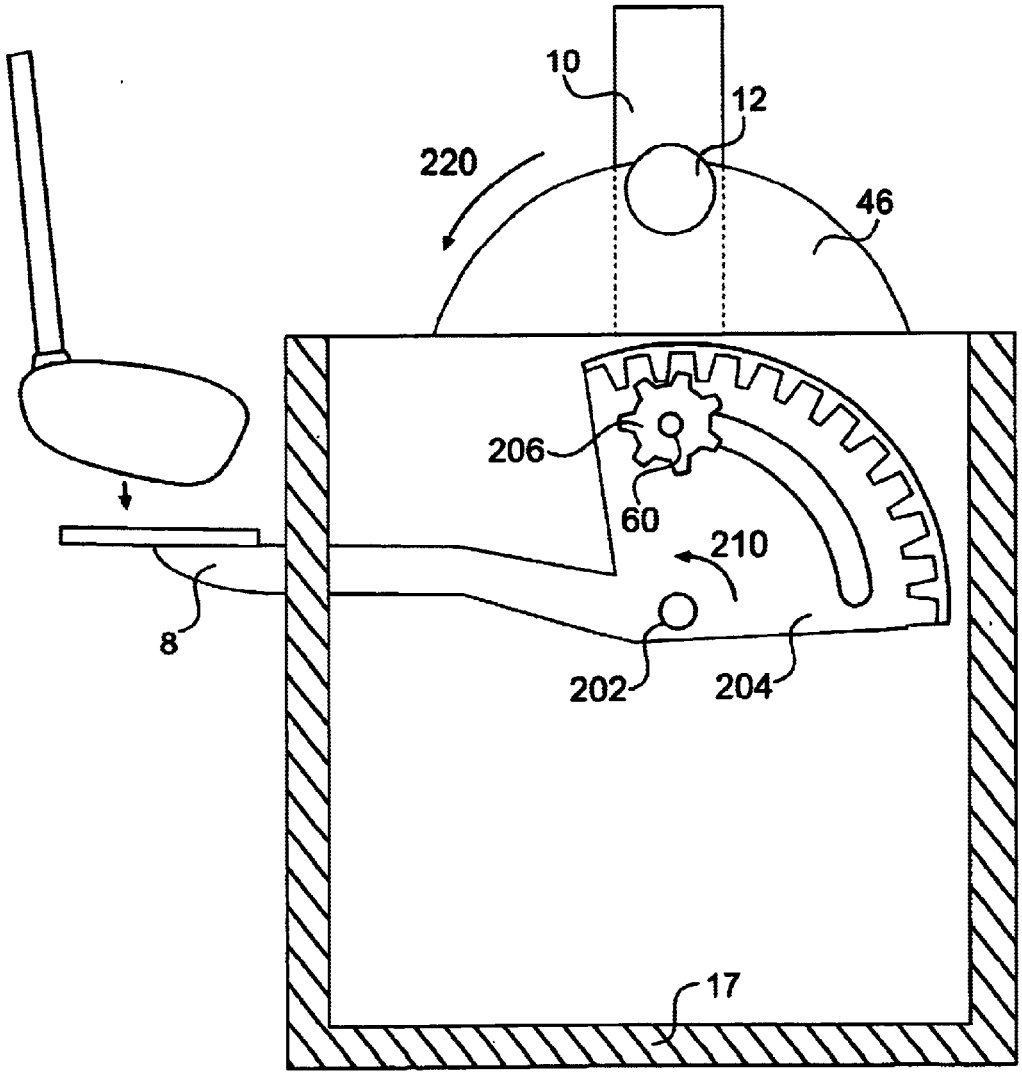
FIG. 11 is an illustrative view of a fourth embodiment of a transmission linkage of the present invention.

FIG. 11 shows a fourth embodiment of the transmission linkage of the present invention. Actuator 8 is rigidly linked to a lever 230 through a connection 220. Connection 220 is rigidly linked to shaft 60. Lever 230 is connected to housing 17 (not a part of the transmission linkage) via a spring 240. When actuator 8 is pressed down with a minimum force, lever 230 moves in the direction of arrow 250, shaft 60 rotates to drive tube 10 to dispense a golf ball onto a tee. The tension in spring 240 is properly adjusted in such a way that a minimum force is required to press down actuator 8 to accomplish all those rotations.

Figure 12A:
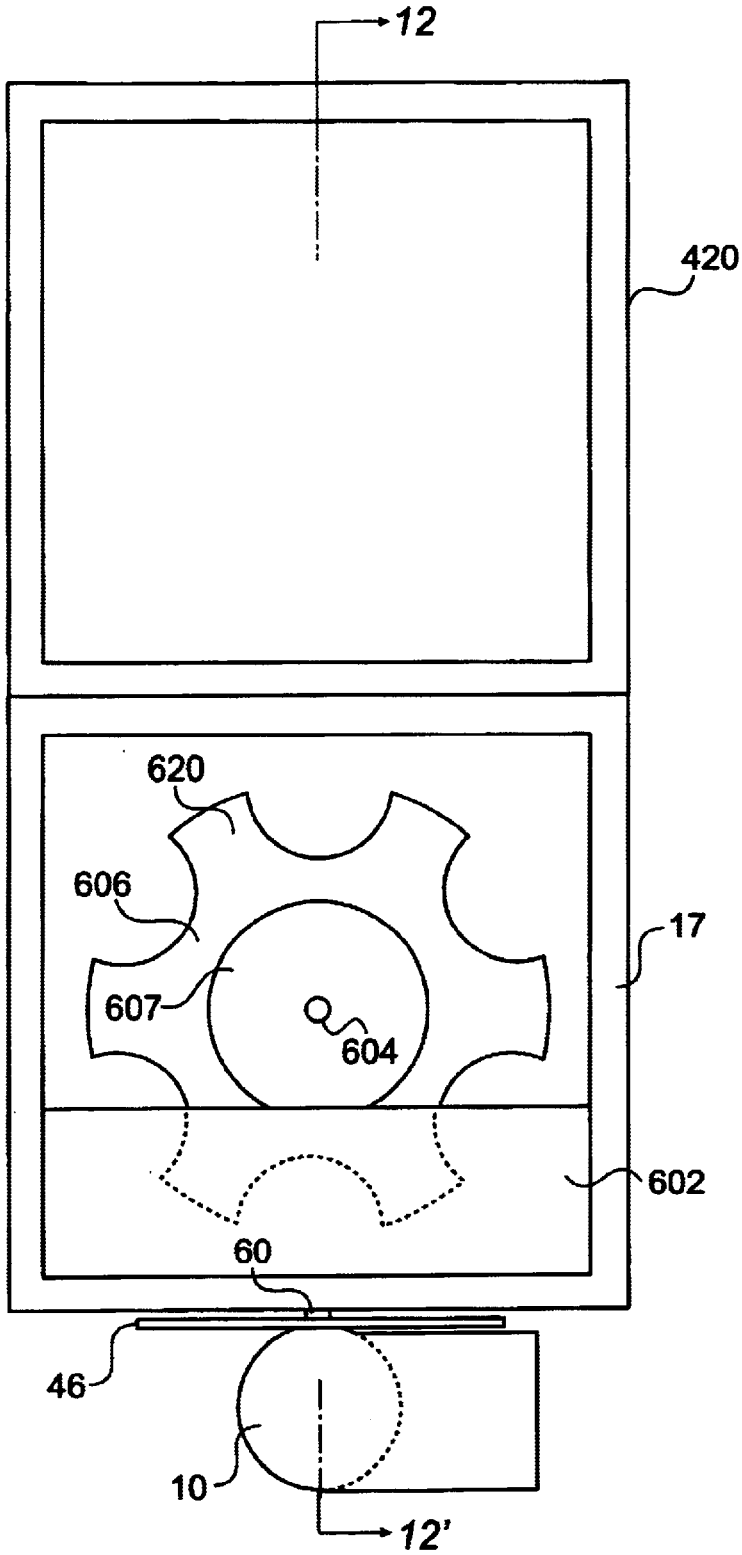
FIG. 12 is an illustrative view of a fifth embodiment of a transmission linkage of the present invention.
Figure 12B:
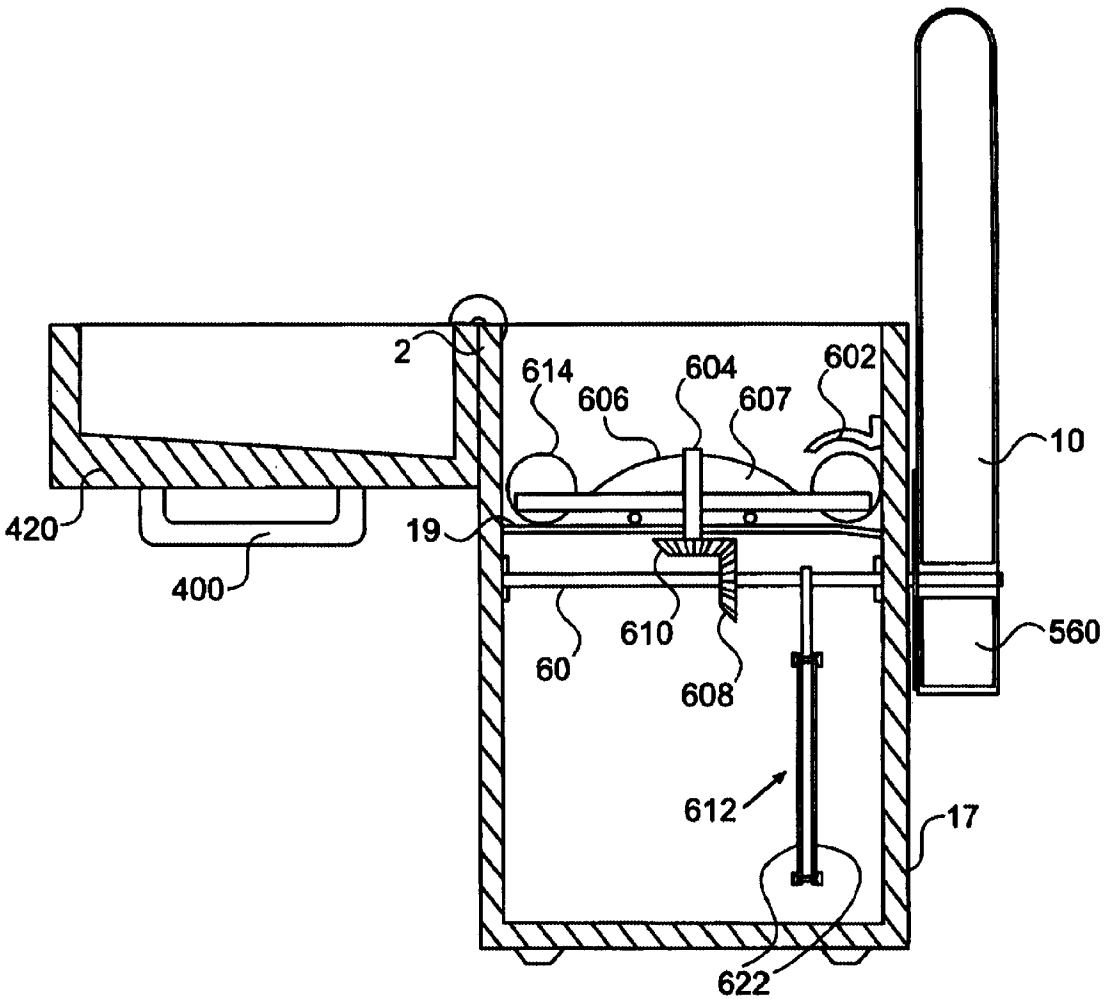

FIG. 12 shows a fifth embodiment of the transmission linkage of the present invention. Actuator 8 is rigidly linked to a lever 330 through a connection 320. Connection 320 is rigidly linked to shaft 60. Lever 330 is connected to housing 17 (not a part of the transmission linkage) via a spring 340. Lever 330 is also rigidly connected a weight component 360. When actuator 8 is pressed down with a minimum force, lever 330 moves in the direction of arrow 350, shaft 60 rotates to drive tube 10 to dispense a golf ball onto a tee. The tension in spring 340 and the weight of weight component 360 are properly adjusted in such a way that a minimum force is required to press down actuator 8 to accomplish all those rotations.

The weight of the extension arm or other components and tension of the spring(s) in these transmission linkages can be properly adjusted to achieve a proper balance so that a minimum force is required to press down the actuator when these transmission linkages of the present invention are installed in golf ball placement devices.

Preferably, the minimum force used to press down the actuator in the present invention is less than 10 lbs. More preferably the minimum force is about the weight of a regular golf club.

Another feature of the transmission linkage of the present invention is its motion amplification effect. The motion amplification effect means that the linkage can convert a relative small movement of the actuator 8 into a relatively large movement of open end 14 of tube 10 to place a golf ball. To achieve such a feature, proper dimensions (or lengths) of the actuator, the lever(s), the extension arm, and the tube are needed. The choice of the proper dimensions for these components to achieve this motion amplification effect is well known to a person skilled in the art.

In a fourth aspect, the present invention relates to a golf ball placement device that is light weight and portable.

Figure 13:
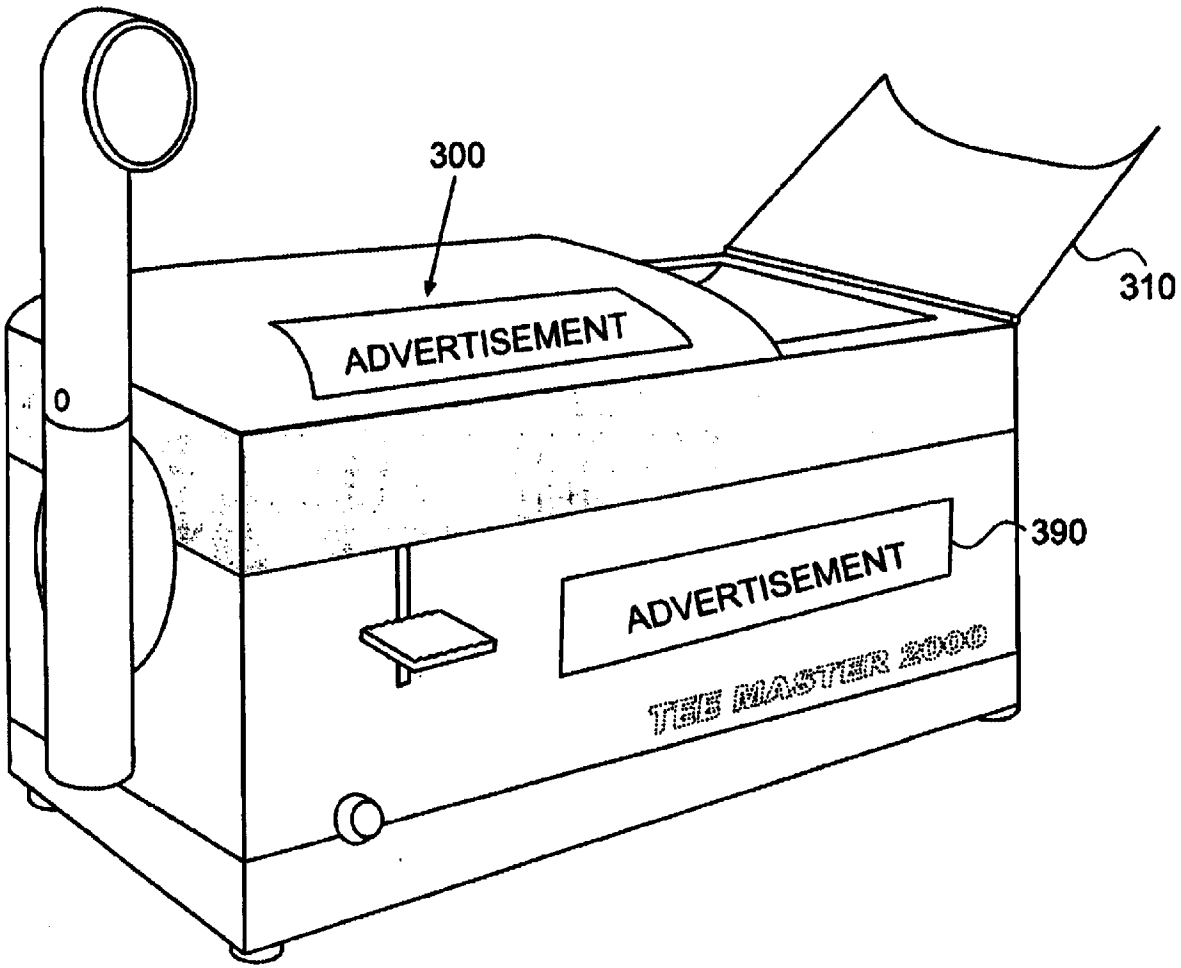
FIG. 13 is an elevated side view of a golf ball placement device of the present invention with a top cover and a place to hold an advertisement.

Preferably, the portable golf ball placement device of the present invention may further include a top cover to prevent rain or other unwanted debris from dropping into this device. FIG. 13 shows one embodiment of the covered device. A top cover 300 covers the top portion of device 15 and ball container 2. Cover 300 can optionally contains a lid 310 hinged to housing 17.

More preferably, as shown in FIGS. 14 and 15, the device of the present invention may further include a handle 400 on a hinged top cover 420 which further contains a locking mechanism 410 to lock top cover 420 to housing 17. The device can be lifted using handle 400. Portion 450 (also shown in FIG. 16) of tube 10 is detachable for easy storage and a better portability. The device may be made in a smaller scale for even a better portability. The device may further include a side cover 440 to cover tube 10. Portion 430 of side cover, which may optionally include an attached golf tee 460, is hinged to housing 17. During practice, portion 430 can be flipped down and serve as a practice tee. Once all the covers are closed, the portable golf ball placement device looks like a legal brief case with all its moving parts protected by the covers. Such a design makes this device portable and durable.

Preferably, the total weight of this portable golf ball placement device is less than 40 lbs without taking into account of the golf ball held therein. More preferably, the total weight of this portable golf ball placement device is less than 25 lbs. Most preferably, the total weight of this portable golf ball placement device is less than 15 lbs for a good portability.

The portable golf ball placement device of the present invention can optionally include an advertisement placed on its covers.

It will now be understood that what has been disclosed herein comprises a unique golf ball placement device, which finds particularly advantageous application for use in a golf practice facility such as a driving range where a golfer may wish to practice its swing and hitting the ball using a series of teed golf balls. The present invention makes it possible to tee up a large number of golf balls consecutively in a convenient manner by simply pressing down the actuator using the golfer's club. The present invention further obviates any requirement for electrical components in a golf ball placement device. The device of the present invention can be produced a relatively low cost with a great reliability. The device of the present invention is also relatively lightweight and portable and can easily set up in most golf practice ranges. The device of the present invention can be operated effortlessly using a minimum force because of the design of its transmission linkage.

The foregoing detailed description of the invention and examples are not intended to limit the scope of the invention in any way and should not be construed as limiting the scope of the invention. The scope of the invention is to be determined from the claims appended hereto.

What is claimed is:

1. A golf ball placement device comprising:

a housing;

a golf ball container located in the housing and provided with a golf ball outlet;

a tube pivotally connected to the housing, the tube including a golf ball inlet and an open end;

an actuator;

transmission means for converting a motion of the actuator into a pivotal motion of the tube, the transmission means being mounted in the housing and being connected to the actuator and the tube, wherein said transmission means is properly balanced to enable the golf ball placement device to place a golf ball when a minimum force is applied to the actuator; and wherein the transmission means for converting a motion of the actuator into a pivotal motion of the tube comprises:

a first rotating shaft inserted into the housing;

a first lever having a first end and a second end, wherein the first lever is rigidly connected to the actuator at the first end of the first lever, wherein the first lever is connected to the first rotating shaft at the first end, wherein the actuator is linked to the first shaft, and wherein when actuator pivotally moves, the second end of the first lever moves pivotally around the first rotating shaft;

a second rotating shaft inserted into the housing, wherein the tube is rigidly connected to the second rotating shaft;

a second lever having a first end and a second end, wherein the second lever is rigidly connected to the second rotating shaft at the first end of the second lever, the second end of the second lever moves around the second rotating shaft as the second rotations shaft rotates; and an extension arm contains a first connection point and a second connection point, wherein the first connection point is pivotally connected to the second end of the first lever and the second connection point is pivotally connected to the second end of the second lever.

2. The golf ball placement device claimed as in claim 1 further comprising a golf ball agitator having a narrow end and a head, wherein the golf ball agitator is pivotally connected to the housing at the narrow end, wherein the golf ball container has a bottom and a slot at the bottom, wherein the head of the golf ball agitator can be moved pivotally through the slot of the golf ball container, and wherein the motion of the actuator actuates a pivotal motion of the golf ball agitator through the slot of the golf ball container.

3. The golf ball placement device claimed as in claim 1 further comprising a tee height adjuster linked to the housing;

and a top cover which covers the ball container.

4. The golf ball placement device claimed as in claim 1, wherein the transmission means for converting a motion of the actuator into a pivotal motion of the tube is properly balanced using springs and weights.

5. The golf ball placement device claimed as in claim 1, wherein the transmission means for converting a motion of the actuator into a pivotal motion of the tube further comprises a spring linking the first rotation shaft and the extension arm, wherein the spring has a tension and the extension arm has a weight, and wherein the tension of the spring and the weight of the extension arm are properly adjusted to enable to the minimum force to press down the actuator.

6. The golf ball placement device claimed as in claim 1, wherein the transmission means for converting a motion of the actuator into a pivotal motion of the tube further comprises a weight component in the tube.

7. A golf ball placement device comprising:

a housing;

a golf ball container located in the housing and provided with a golf ball outlet;

a tube pivotally connected to the housing, the tube including a golf ball inlet and an open end;

an actuator;

a transmission linkage being mounted in the housing and being connected to the actuator and the tube, wherein a motion of the actuator is converted into a pivotal motion of the tube through the transmission linkage, wherein the transmission linkage is properly balanced and it requires a minimum force to actuate the actuator to rotate the tube from the substantially vertical position to the substantially horizontal position;

a side cover hinged to the housing, wherein a portion of the side cover can be flipped down to serve as a golf tee.

8. The golf ball placement device claimed as in claim 7 further comprising a golf ball agitator having a narrow end and a head, wherein the golf ball agitator is pivotally connected to the housing at the narrow end, wherein the golf ball container has a bottom and a slot at the bottom, wherein the head of the golf ball agitator can be moved pivotally through the slot of the golf ball container, and wherein the motion of the actuator actuates a pivotal motion of the golf ball agitator through the slot of the golf ball container.

9. The golf ball placement device claimed as in claim 7 further comprising a tee height adjuster linked to the housing and a cover which covers the golf ball container, wherein the tube moves pivotally from a substantially vertical position to a substantially horizontal position so that a golf ball rolls out the tube thorough the open end of the tube to place the golf ball, and wherein another golf ball rolls out of the outlet of the golf ball container and rolls into the tube thorough the golf ball inlet of the tube when the tube returns to the substantially vertical position after placing the golf ball.

10. The golf ball placement device claimed as in claim 7 further comprising a place to hold an advertisement on an element selected from the group consisting of the housing and the cover.

11. A golf ball placement device comprising:

a housing;

a golf ball container located in the housing and provided with a golf ball outlet;

a tube pivotally connected to the housing, the tube including a golf ball inlet and an open end;

an actuator;

a transmission linkage being mounted in the housing and being connected to the actuator and the tube, wherein a motion of the actuator is converted into a pivotal motion of the tube through the transmission linkage, wherein the transmission linkage is properly balanced and it requires a minimum force to actuate the actuator to rotate the tube from the substantially vertical position to the substantially horizontal position; and wherein the transmission linkage comprises:

a first rotating shaft inserted to the housing;

a first lever having a first end and a second end, wherein the first lever is rigidly connected to the actuator at the first end of the first lever, wherein the first lever is connected to the first rotating shaft at the first end, wherein the actuator is linked to the first shaft, and wherein when actuator pivotally moves, the second end of the first lever moves pivotally around the first rotating shaft;

a second rotating shaft inserted to the housing, wherein the tube is rigidly connected to the second rotating shaft;

a second lever having a first end and a second end, wherein the second lever is rigidly connected to the second rotating shaft at the first end of the second lever, the second end of the second lever moves around the second rotating shaft as the second rotating shaft rotates;

an extension arm contains a first connection point and a second connection point, wherein the first connection point is pivotally connected to the second end of the first lever and the second connection point is pivotally connected to the second end of the second lever.

12. The golf ball placement device claimed as in claim 11, wherein the transmission linkage further comprises a spring linking the first rotation shaft and the extension arm, wherein the spring has a tension and the extension arm has a weight, and wherein the tension of the spring and the weight of the extension arm are properly adjusted to enable to the minimum force to press down the actuator.

13. The golf ball placement device claimed as in claim 11, wherein the transmission linkage further comprises a weight component in the tube.

14. A golf ball placement device comprising:

a housing;

a golf ball container located in the housing and provided with a golf ball outlet;

a tube pivotally connected to the housing, the tube including a golf ball inlet and an open end;

an actuator;

a first rotating shaft inserted to the housing;

a first lever having a first end and a second end, wherein the first lever is rigidly connected to the actuator at the first end of the first lever, wherein the first lever is connected to the first rotating shaft at the first end, wherein the actuator is linked to the first shaft, and wherein when actuator pivotally moves, the second end of the first lever moves pivotally around the first rotating shaft;

a second rotating shaft inserted to the housing, wherein the tube is rigidly connected to the second rotating shaft;

a second lever having a first end and a second end, wherein the second lever is rigidly connected to the second rotating shaft at the first end of the second lever, the second end of the second lever moves around the second rotating shaft as the second rotating shaft rotates;

an extension arm contains a first connection point and a second connection point, wherein the first connection point is pivotally connected to the second end of the first lever and the second connection point is pivotally connected to the second end of the second lever, and a golf ball agitator having a narrow end and a head, wherein the golf ball agitator is pivotally connected to the housing at the narrow end, wherein the golf ball container has a bottom and a slot at the bottom, wherein the head of the golf ball agitator can be moved pivotally through the slot of the golf ball container, and wherein a motion of the actuator actuates a pivotal motion of the golf ball agitator through the slot of the golf ball container.

15. The golf ball placement device claimed as in claim 14 comprising a tee height adjuster linked to the housing;

a cover that covers the ball container;

a weight component in the tube; and a place to hold an advertisement on an element selected from the group consisting of the housing and the cover, wherein the tube moves pivotally from a substantially vertical position to a substantially horizontal position so that a golf ball rolls out the tube thorough the open end of the tube to place the golf ball, and wherein another golf ball rolls out of the outlet of the golf ball container and rolls into the tube thorough the golf ball inlet of the tube when the tube returns to the substantially vertical position after placing the golf ball.

16. A portable golf ball placement device comprising:

a housing;

a golf ball container located in the housing and provided with a golf ball outlet;

a tube pivotally connected to the housing, the tube including a golf ball inlet and an open end;

an actuator;

a transmission linkage connected both to the actuator, the tube and the housing, wherein a motion of the actuator is converted into a pivotal motion of the tube through the transmission linkage, wherein the transmission linkage is properly balanced so that it requires a minimum force to press down the actuator to rotate the tube from the substantially vertical position to the substantially horizontal position;

a top cover that covers the ball container, and a side cover hinged to the housing, wherein the side cover can be opened to serve as a golf tee, wherein when both the top and side covers are closed, the portable golf ball placement device has a substantially brief case shape.

17. A portable golf ball placement device as claimed in claim 16 further comprising a handle connected to the top cover.

18. A transmission linkage installed inside a housing of a golf ball placement device having a tube for dispensing a golf ball and an actuator to actuate the rotating of the tube comprising:

a first rotating shaft inserted to the housing;

a first lever having a first end and a second end, wherein the first lever is rigidly connected to the actuator at the first end of the first lever, wherein the first lever is connected to the first rotating shaft at the first end, wherein the actuator is linked to the first shaft, and wherein when actuator pivotally moves, the second end of the first lever moves pivotally around the first rotating shaft;

a second rotating shaft inserted to the housing, wherein the tube is rigidly connected to the second rotating shaft;

a second lever having a first end and a second end, wherein the second lever is rigidly connected to the second rotating shaft at the first end of the second lever, the second end of the second lever moves around the second rotating shaft as the second rotating shaft rotates;

an extension arm having a first connection point and a second connection point, wherein the first connection point is pivotally connected to the second end of the first lever and the second connection point is pivotally connected to the second end of the second lever.

19. The golf ball placement device claimed as in claim 18, wherein the transmission linkage further comprises a spring links the first rotation shaft and the extension arm, wherein the spring has a tension and the extension arm has a weight, and wherein the tension of the spring and the weight of the extension arm are properly adjusted to enable to the minimum force needed to press down the actuator.

20. The golf ball placement device claimed as in claim 18, wherein the transmission linkage further comprises a weight component with a suitable weight in the tube.

* * * * *